United States Patent [19]

Bone

[11] 4,192,358

[45] Mar. 11, 1980

[54] AIR POWERED INSTALLATION OF FASTENERS

[75] Inventor: Arnold R. Bone, Needham, Mass.

[73] Assignee: Dennison Manufacturing Company, Framingham, Mass.

[21] Appl. No.: 935,206

[22] Filed: Aug. 21, 1978

[51] Int. Cl.[2] ..... B21F 9/02

[52] U.S. Cl. ..... 140/123.6; 140/93.2

[58] Field of Search ..... 140/123.6, 93.2

[56] References Cited

U.S. PATENT DOCUMENTS

| | | | |
|---|---|---|---|
| 3,254,680 | 6/1966 | Caveney et al. | 140/123.6 |
| 3,865,156 | 2/1975 | Moody et al. | 140/123.6 |
| 4,047,545 | 9/1977 | Paradis | 140/123.6 |

*Primary Examiner*—Lowell A. Larson
*Attorney, Agent, or Firm*—George E. Kersey

[57] ABSTRACT

An improved tool for the installation of objects such as cable tie fasteners, including a device for penumatically powering the tool's operation. An air cylinder appended to the tool contains a piston and rod assembly which is coupled to machinery within the tool for tensioning and severing the object to be installed. The piston and rod assembly is actuated by the movement of a valve within the cylinder, which valve is in turn linked to the tool's trigger. Piston and valve springs restore the piston and rod assembly and the valve to their original positions upon release of the trigger.

6 Claims, 5 Drawing Figures

AIR POWERED INSTALLATION OF FASTENERS

BACKGROUND OF THE INVENTION

The present invention relates to a tool for installation of cable ties and the like, and more particularly to powering such a tool.

Cable tie fasteners are commonly installed, for example, by wrapping their straps around groups of articles and then threading the straps through locking heads. The installation is completed by pulling on the free ends of the straps until the articles are securely bundled. To achieve a suitable installation it is desirable to use a tool which grips and tensions the free end of the strap. The free end is then severed in the vicinity of the head when a specified level of tensioning has been reached.

Installation tools in common use contain a trigger actuated mechanism that tensions the strap to a predetermined level and actuates a cutter to sever the strap.

Joseph R. Paradis, U.S. Pat. No. 4,047,545, discloses an installation tool of this type. The tool is activated by a force exerted upon its trigger by the operator, which force is smaller than that required to operate other tools for this purpose in the prior art. Where the tool is to be used in prolonged operation, however, the repeated application of even such a reduced force causes operator fatigue. Such fatigue is especially pronounced in the installation of heavier cable ties.

Accordingly, it is one object of the invention to provide a tool for installing cable tie fasteners and the like which may be continuously operated with minimal effort. A related object is the avoidance of operator fatigue in repeated installation of cable ties, regardless of the weight or strength of the fastener installed.

Another object of the invention is the provision of apparatus to assure the application of the proper amount of force required to install cable ties of various sizes and weights.

Other illustrative installation tools of the prior art are disclosed in U.S. Pat. Nos. 3,735,784; 3,712,346; 3,661,187; 3,433,275; 3,344,815; 3,332,454; 3,284,076; 3,173,456; 3,169,560 (U.S. Pat. No. Re. 26,492); 3,168,119; 3,154,114; 2,729,994; 2,882,934; and 2,175,478.

SUMMARY OF THE INVENTION

In accomplishing the above and related objects, the improved installation tool of the invention incorporates a pneumatic power assembly, which is mounted on the rear of the tool. The powering assembly comprises an air cylinder containing a piston and rod assembly, the latter being coupled to machinery within the tool for controlled tensioning and severing of cable ties and similar objects. The piston is actuated by the motion of a valve within the cylinder, such motion resulting from the depression of the tool's trigger. Release of the trigger causes the valve and the piston and rod assembly to return to their idle positions, under the influence respectively of a valve spring and piston spring.

In accordance with one aspect of the invention, the trigger is coupled by a trigger link to a valve spool. Depression of the trigger induces the valve spool to slide within a valve spool chamber, which causes an O-ring at one end of the valve spool to seal that end of the valve spool chamber while releasing an O-ring seal at the other end of the valve spool chamber. The converse process occurs upon release of the trigger due to the countervailing pressure exerted by a valve spring.

When the valve spool is in its actuated position, high pressure air is admitted through an aperture into the valve spool chamber. When the valve spool returns to its idle position, the high pressure air is vented through a second aperture.

In accordance with another aspect of the invention, the valve spool chamber is connected to a tunnel to a piston chamber, which houses the piston and rod assembly. Pressurization of the valve spool chamber and the piston chamber causes the motion of the piston toward the rear of the air cylinder. Venting of the valve spool chamber and piston chamber results in the return of the piston due to the pressure exerted by a piston spring.

In accordance with a further aspect of the invention, the piston rod is coupled at the end opposite the piston to a link connecting assembly in the handle of the tool. The link connecting assembly is secured at its front end to toggle linkages. A rearward motion of the piston and rod assembly exerts a corresponding force upon the toggle linkages, which in turn is transmitted to a tensioning member. When this force exceeds the counterforce exerted upon the linkages by a toggle arm connected to a spring within the handle of the tool, the linkages collapse. Collapse of the linkages results in the severance of an object such as a cable tie, as disclosed in U.S. Pat. No. 4,047,545. Upon release of the trigger, the tool will assume readiness for further use.

BRIEF DESCRIPTION OF THE DRAWINGS

The above and additional aspects of the air powered installation tool of the invention are illustrated by reference to the detailed description which follows, taken together with the drawings in which.

DETAILED DESCRIPTION

Figure 1:
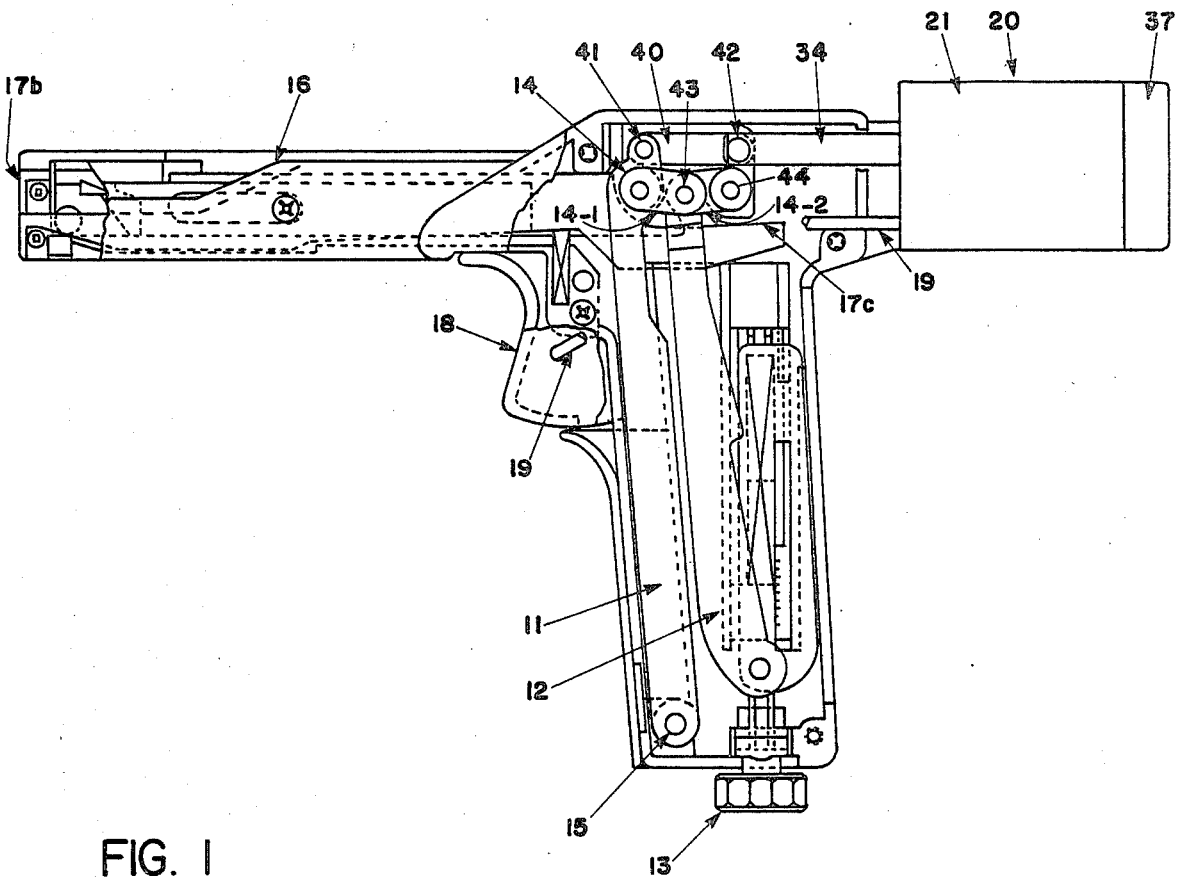
FIG. 1 is a partial sectional view of an installation tool in accordance with a preferred embodiment of the invention.
Figure 2:
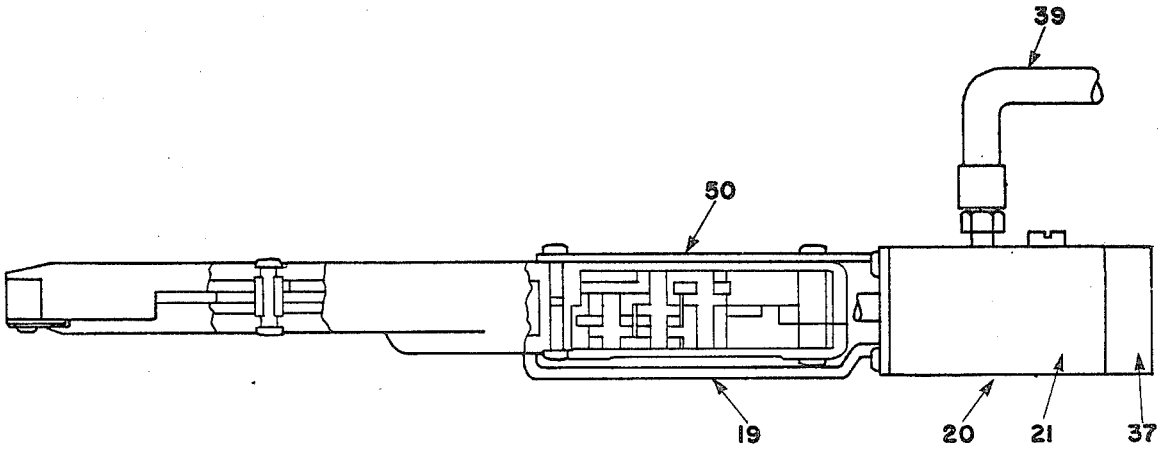
FIG. 2 is a top view of the tool of FIG. 1, with portions broken away.

Reference should be had to FIGS. 1 through 5 for a detailed description of the air powered installation tool of the invention. A preferred embodiment of the tool is shown at 10 in the cutaway view of FIG. 1. Significant features which are shared with the installation tool of U.S. Pat. No. 4,047,545 include a tensioning assembly 16 for engaging a free end of an object such as a cable tie fastener, a pivotted cutoff lever 17 with a cutter blade **17*b* for severing the free end after tensioning, an actuator lever 11, a toggle arm 12, toggle linkages 14-1 and 14-2, and a trigger 18. The operations of the tool of the present invention and the hand powered version of the above patent are identical in many respects. The most significant differences arise in the method and apparatus used in transmitting a force exerted upon trigger 18 to effect the movement of the actuator lever 11** and the parts connected thereto.

Figure 3:
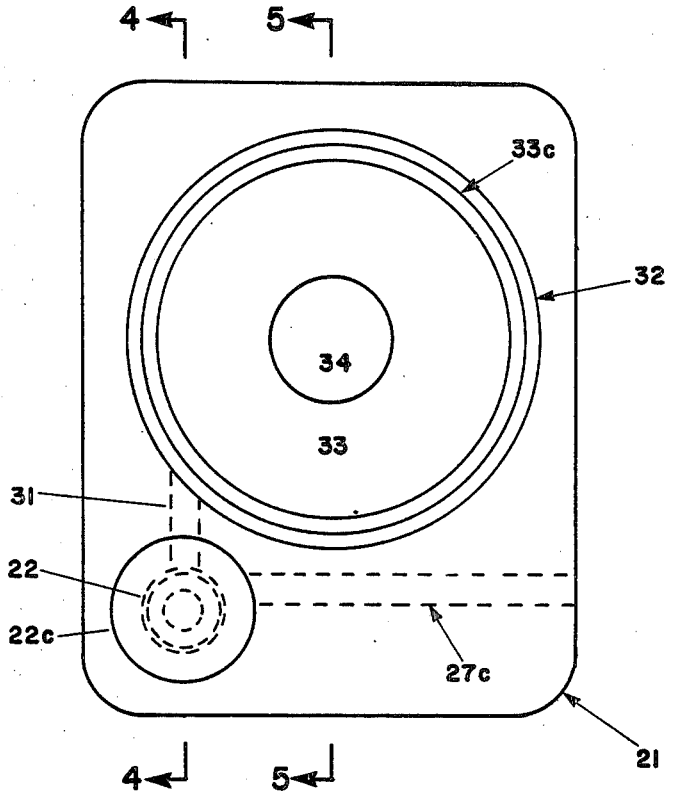
FIG. 3 is an end view of a preferred air power assembly with the cylinder head removed.

Depression of the trigger 18 causes a rearward movement of trigger link 19 (partially shown in FIG. 1). As can be seen in the top view of FIG. 2, trigger link 19 is advantageously exterior to the handle of installation tool 10, and extends into air power assembly 20. Air power assembly 20 comprises an air cylinder block 21 capped by a cylinder head 37, and is illustratively mounted on a bracket 50 on the side of the tool's handle. FIG. 3 shows an end view of air cylinder block 21 as seen from the rear, with cylinder head 37 removed. Air cylinder block 21 contains two cylindrical cavities, a smaller channel 22c containing a valve spool assembly 22, and a central piston chamber 32 housing a piston and rod assembly 33, 34.

Figure 4:
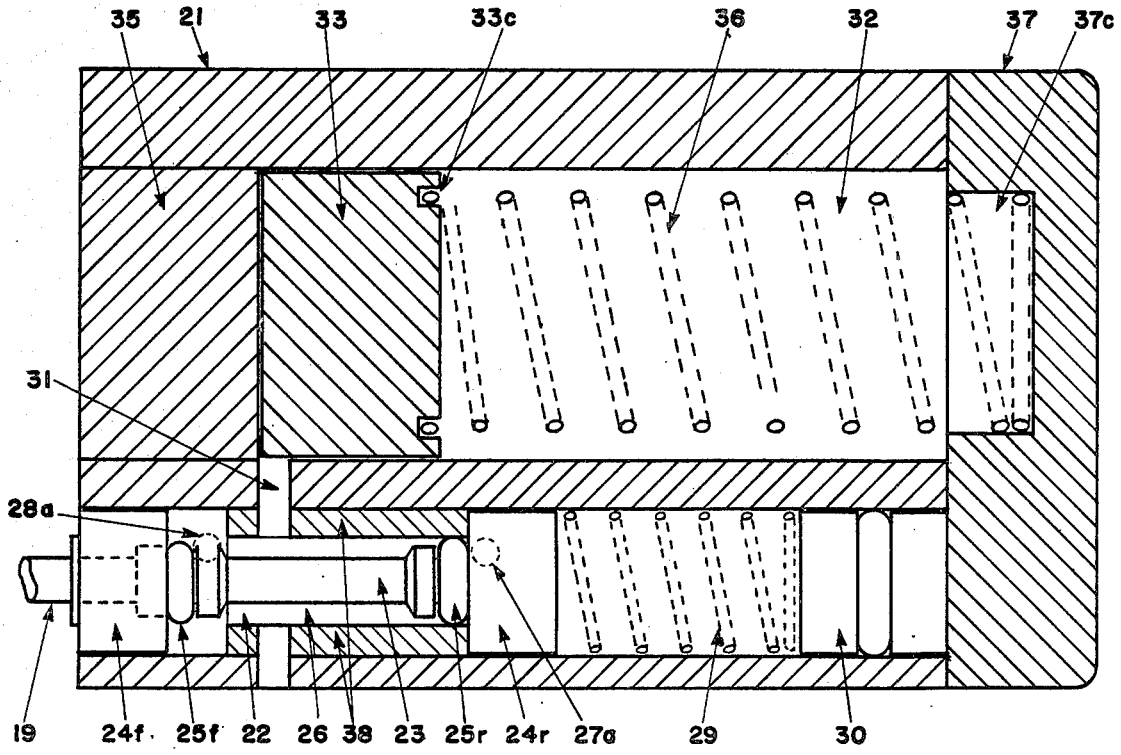
FIG. 4 is a side view of the air power assembly of FIG. 3, in a section taken along the lines 4—4, with the cylinder head in place.
Figure 5:
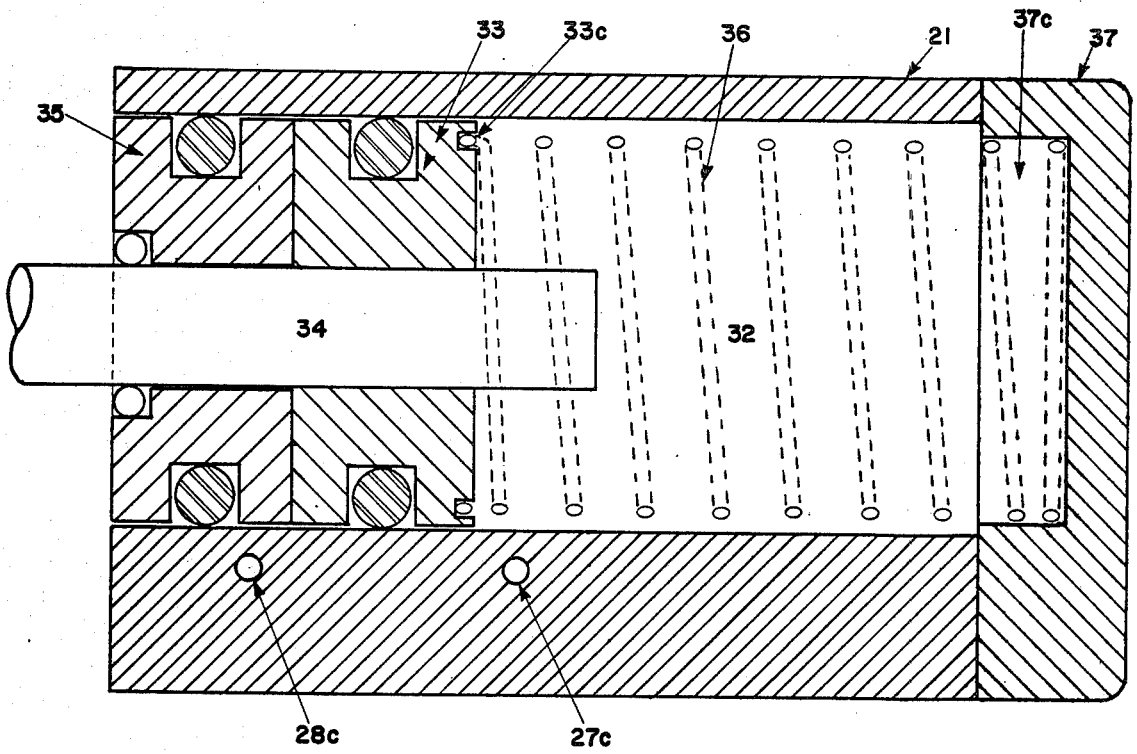
FIG. 5 is an alternative side view of the air power assembly of FIG. 3, in a section taken along the lines 5—5, with the cylinder head in place.

Air power assembly 20 may be seen in more detail from the side in the sectional view of FIG. 4 taken through the lines 4—4 in FIG. 3. The rearward motion of trigger link 19 causes a similar motion of valve spool assembly 22, to which the trigger link is attached. Valve spool assembly 22 slides through a channel 22c which runs the length of cylinder block 21. Valve spool assembly 22 includes a valve spool 23, a front spool cap 24f, a rear spool cap 24r, and front and rear O-rings 25f and 25r. The movement of the valve spool assembly is limited by bushing 38, which defines an interior valve spool chamber 26. A compression spring 29 occupies the rear portion of the channel 22c, between rear spool cap 24r and a plug 30. Thus, valve spool assembly 22 is forced rearward by trigger link 19, compressing valve spring 29, until front spool cap 24f rests against bushing 38.

Channel 22c contains two apertures, one on either side of bushing 38. Pressurizing aperture 27a is connected by a channel 27c to a source of high pressure air (this is shown at 39 in FIG. 2). Source 39 is illustratively an air hose connected to an air supply, normally at 80 PSI. Venting aperture 28a is connected by a channel to a venting port (not shown) in the side of cylinder block 21. When the valve spool assembly is forced to its rearward position, valve spool chamber 26 communicates with pressurizing aperture 27a, permitting the inflow of high pressure air. In this activated position of the valve spool assembly 22, front spool cap 24f seals venting aperture 28a while O-ring 25f seals the forward end of valve spool chamber 26. When valve spool assembly 22 is forced foreward (as shown in FIG. 4) by valve spring 29, rear spool cap 24r seals pressurizing aperture 27a and O-ring 25r seals the rear end of valve spool chamber 26, while cap 24f and O-ring 25f slide forward, allowing the escape of high pressure air through venting aperture 28a.

Valve spool chamber 26 is connected to a piston chamber 32 by a tunnel 31. When valve spool assembly 22 is forced to its rearmost position by the depression of trigger 18, high pressure air passes into valve spool chamber 26 and through tunnel 31 into piston chamber 32. With reference to the side sectional view of FIG. 5, taken through the center of the piston chamber, a cylinder plug 35 defines one end of the chamber. High pressure air enters the chamber between cylinder plug 35 and piston 33, forcing the piston and its connected piston rod 34 toward the rear of piston chamber 32. A compression spring 36 resists this rearward movement, but does not prevent it. Piston spring 36 is anchored at one end in an annular groove 33c in the wall of piston 33, and at the other end in a cavity 37c in cylinder head 37. When high pressure air is vented from the valve spool chamber 26 and piston chamber 32, piston spring 36 causes the return of the piston and rod assembly to its forward, idle position.

With further reference to FIG. 1, piston rod 34 extends into the handle of the installation tool 10, where it is pivotally connected at a pin 42 to a link connecting assembly 40. Link connecting assembly 40 is connected at its other, forward end to an extension of an actuator lever 11 by a pin 41. As in U.S. Pat. No. 4,047,545, actuator lever 11 is also connected at its top to toggle linkages 14.

As link connecting assembly 40 moves rearward in conjunction with piston rod 34, it exerts a corresponding force on the top of actuator lever 11. This force is transmitted to the toggle linkages 14 due to the pivotal mounting 15 of actuator lever 11 at its bottom. Toggle link 14-2 is pivotally connected at 44 to a rear portion of tensioning assemblage 16, so that the force on toggle linkages 14 is transmitted in turn to the tensioning assemblage. There is a tendency, however, for the toggle links 14 (which are never perfectly aligned) to buckle downward in response to the rearward force thus exerted. To maintain the toggle linkages 14 in position to transmit this force, a countervailing force is applied to the midpoint 43 of the toggle links through a toggle arm 12. Thus, when the toggle links 14-1 and 14-2 are maintained in approximate alignment, the force exerted by link connecting assembly 40 causes tensioning assemblage 16 to be drawn toward the rear of the installation tool 10, as disclosed in U.S. Pat. No. 4,047,545.

When the tensioning force applied from the link connecting assembly 40 exceeds the countervailing force applied to toggle arm 12, the toggle linkages 14 collapse by pivotting with respect to both the actuator lever 11 and the tensioning assemblage 16, and engage a cam surface 17c of the cutoff lever 17. This results in the severing of the free end of the engaged object by cutter blade 17b. The countervailing force that is applied to the toggle linkages 14 may be realized in a wide variety of ways. In a preferred embodiment, this force is provided by a compression spring cage, allowing the threshold tension to be controlled by the user's rotating a tension control knob 13. These features are discussed in detail in U.S. Pat. No. 4,047,545.

When the operator releases trigger 18, valve spring 29 forces the valve spool assembly 22 to return to its forward, starting position. This causes the trigger 18 to return to a ready position by means of trigger link 19. Because of the valving arrangement discussed above, valve spool chamber 26 and piston chamber 32 are vented to atmosphere, and the piston and rod assembly returns to its forward position. The internal mechanisms within the handle and mouth of the tool 10 are in turn returned to their starting positions due to a forward motion of the link connecting assembly 40, and the installation tool 10 is ready for further use.

While various aspects of the invention have been set forth by the drawings and the specification, it is to be understood that the foregoing detailed description is for illustration only and that various changes in parts, as well as the substitution of equivalent constituents for those shown and described, may be made without departing from the spirit and scope of the invention as set forth in the appended claims. In particular, although the air powering apparatus of the invention has been shown as incorporated in an installation tool of the type disclosed in U.S. Pat. No. 4,047,545, it may be used to control the tensioning apparatus in tools of other designs which are suitable for installing cable ties, fasteners and the like.

I claim:

1. An improved tool for tensioning an item having a free end, of the type including means for gripping and drawing the free end of the item, means for severing an end portion of said item, apparatus for applying force to said drawing means to apply tension to the end of said item, and means for operating the severing means when the applied force reaches a prescribed level, wherein the improvement comprises improved apparatus for applying force to said drawing means, comprising:

a piston and piston rod assembly, housed in a piston chamber having actuating and non-actuating ends;

a valve assembly having activated and non-activated positions, comprising a housing containing a channel, wherein the wall of the channel includes a "pressurizing" aperture and a "venting" aperture, with the pressurizing aperture connected by a duct to the source of high pressure air and the venting aperture connected to a venting port, and wherein a tunnel terminating in the channel between said apertures connects the channel to the piston chamber;

a valve spool which may slide within said channel;

a filler member creating a narrowed segment of said channel, located between said pressurized and venting apertures, whereby the tunnel connects the piston chamber to the narrowed segment of the channel;

first and second capping members on each end of said valve spool configured such that when the valve spool is in the activated position, the first capping member seals the narrowed segment of the channel from the venting aperture, whereas when the valve spool is in the non-activated position, the second capping member seals the narrowed segment of the channel from the pressurizing aperture;

a source of high pressure air;

activating means for urging the valve spool and capping members towards the activated position in response to an input signal; and means for linking the piston rod and the drawing means, and for causing force to be applied to said drawing means when the piston moves toward the actuating end of the piston chamber.

2. A tensioning tool in accordance with claim 1 wherein each of the first and second capping members comprises a member for sealing a respective end of the narrowed segment of said channel, and a member for guiding the travel of the valve spool within the channel.

3. A tensioning tool in accordance with claim 1 further comprising means for returning said piston to the non-actuating end of the piston chamber upon escape of high pressure air from the piston chamber, and for allowing the movement of the piston toward the actuating end when high pressure air is introduced into the piston chamber.

4. A tensioning tool in accordance with claim 1 wherein the activating means comprises a trigger, and a member linking the trigger and the valve spool and capping members such that depression of the trigger urges the valve spool and capping members toward the activated position.

5. A tensioning tool in accordance with claim 1 further comprising valve returning means for urging the valve spool and capping members toward the non-activated position, wherein said valve returning means exerts a lesser force than the activating means when the latter is in operation.

6. An improved tensioning tool in accordance with claim 1 of the type further including first and second pivotally connected links connected to the drawing means, and means for maintaining said links in relative alignment until the applied force reaches a prescribed level whereupon said links pivot out of alignment and operate the severing means, wherein the means for linking the piston rod and the drawing means comprises a lever pivotally connected to the first and second links and to a housing of said tool, and a linking member pivotally connected to said lever and to the piston rod.

* * * * *